US008631518B1

(12) United States Patent
Jennings

(10) Patent No.: US 8,631,518 B1
(45) Date of Patent: Jan. 21, 2014

(54) SHOCK ABSORBING, STRETCHABLE FABRIC, HEAD CAP FOR RECEIPT UNDER A HEAD PROTECTION HELMET

(71) Applicant: William J. Jennings, Aurora, CO (US)

(72) Inventor: William J. Jennings, Aurora, CO (US)

( * ) Notice: Subject to any disclaimer, the term of this patent is extended or adjusted under 35 U.S.C. 154(b) by 0 days.

(21) Appl. No.: 13/754,251

(22) Filed: Jan. 30, 2013

(51) Int. Cl.
*A42B 3/00* (2006.01)

(52) U.S. Cl.
USPC ..... 2/411

(58) Field of Classification Search
USPC ..... 2/410, 411, 412, 414, 416, 425, 6.1, 7, 2/8.1, 6.6, 417, 418, 419, 420, 909, 5
See application file for complete search history.

(56) References Cited

U.S. PATENT DOCUMENTS 3,366,971 A * 2/1968 Scherz ..... 2/412
3,609,764 A * 10/1971 Morgan ..... 2/414
4,412,358 A * 11/1983 Lavender ..... 2/412
4,619,003 A * 10/1986 Asbury ..... 2/5
6,240,570 B1 * 6/2001 Wu ..... 2/410
6,243,881 B1 * 6/2001 Brinkman ..... 2/422
6,493,881 B1 * 12/2002 Picotte ..... 2/413
6,675,395 B1 * 1/2004 Abraham ..... 2/425
6,964,066 B2 * 11/2005 Tucker ..... 2/414
8,533,869 B1 * 9/2013 Capuano ..... 2/411

* cited by examiner

*Primary Examiner* — Tejash Patel
(74) *Attorney, Agent, or Firm* — Edwin H. Crabtree; Ramon L. Pizarro

(57) ABSTRACT

A light weight, shock absorbing, shock dissipating, moisture absorbing, stretchable fabric, head cap designed for receipt under a hard shell helmet and over a head of a helmet user. The head cap includes thin sheets of shock absorbing and shock dissipating foam pads. The foam pads are used to limit a shock load or pressure applied to the head. Also, the foam pads help spread the load over a large surface area of the head, thus reducing a potential head injury or potential concussion to the wearer of the head cap. The foam pads are received between a moisture wicking fabric inner liner and an outer liner. The head cap also includes a moisture absorbing head band and head band ties for securing the head band on the user's head.

14 Claims, 4 Drawing Sheets

SHOCK ABSORBING, STRETCHABLE FABRIC, HEAD CAP FOR RECEIPT UNDER A HEAD PROTECTION HELMET

This non-provisional patent application claims the benefit of a provisional patent application and the subject matter found therein, filed on Mar. 5, 2012, Ser. No. 61/634,658, by the subject inventor, and having a title of "Fabric Head Cap with Shock Absorbing Gel Pads".

BACKGROUND OF THE INVENTION (a) Field of the Invention

This invention relates to a protective head cap worn under a hard shell helmet and the like, and more particularly, but not by way of limitation, to a custom fitted, shock absorbing, moisture absorbing, fabric head cap. The head cap is worn under various types of hard shell helmets used in sporting events. The head cap includes shock absorbing and shock dissipating, thin sheet foam pads received between a stretchable, moisture absorbing fabric inner liner and a fabric outer liner.

(b) Discussion of Prior Art

In the sport of baseball, players use hard shell batting helmets with interior padding for protection from a pitched baseball. In the sport of football, players use hard shell football helmets with interior padding for protection from hitting another player, hitting another player's helmet and hitting a hard ground surface. These player helmets, as an example, help prevent a potential head injury, such as a concussion. The subject invention is used as an addition to a hard shelled helmet to further reduce the potential of a head injury during various types of sporting events and outdoor activities.

Heretofore, there have been a number of different types of headgear used for protecting children and adults from head injuries during daily outdoor activities and sporting events. An example of these headgears and head protectors are described in U.S. Pat. No. 4,324,005 to Willis and U.S. published patent applications 2007/0000025 to Picotte, 2009/0222975 to Green et al and 2011/0144539 to Ouchi. None of these prior art references provide the advantages, objects and unique structure and function found in the subject protective fabric head cap with foam padding, as described herein.

SUMMARY OF THE INVENTION

In view of the foregoing, it is a primary objective of the subject invention to provide a light weight, custom fitting, moisture absorbing, fabric head cap. The cap includes thin sheets of shock absorbing and shock dissipating foam pads. The foam pads are used to limit a shock load or pressure applied to the skull. Also, the foam pads help spread the load over a large surface area of the head, thus reducing a potential head injury or potential concussion to the wearer of the head cap.

Another object of the invention is to provide a custom fit on different shapes of a player's head and fit comfortably under a hard shell helmet. The head cap helps fill a void or gap next to foam padding inside the helmet, thus increasing the absorption and dissipation of a shock load on the helmet to the benefit of the player. The fabric head cap can be used with helmets used in baseball, football, hockey, lacrosse, skiing, car racing, bicycling, rodeo, building construction, and other sporting events and outdoor activities where hard shell protective hats are worn.

Yet another object of the fabric head cap is it can include tie strings for holding a player's long hair in a pony tail. Also, the head cap includes a beaver tail to prevent the back of the helmet from chaffing and irritating to the back of the head during the use of the cap. Also, the head cap can be designed in different hat styles and using different types of moisture absorbing fabric with different team colors, with different team logos and with different brand names thereon.

Still another object of the invention is the protective padding used in the head cap is strategically placed next to the most sensitive and exposed areas of the head for increased protection against a potential head injury.

These and other objects of the present invention will become apparent to those familiar with different types of protective head gear when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject shock absorbing fabric head cap, and in which.

DETAILED DESCRIPTION OF THE PREFERRED EMBODIMENTS

Figure 1:
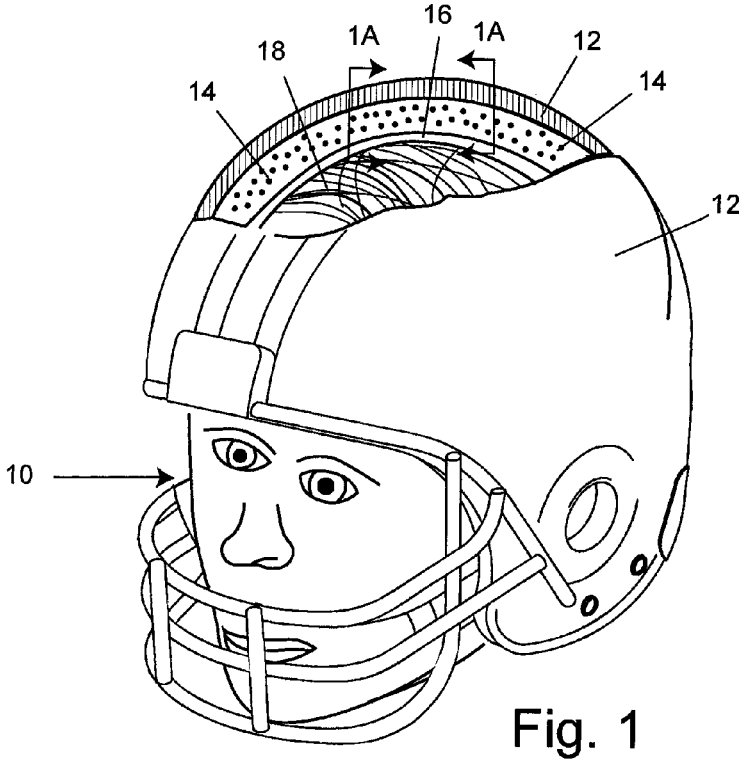
FIG. 1 is a perspective view of a male model wearing a typical hard shell helmet. A portion of the helmet has been cutaway to illustrate foam padding inside the helmet and a space or gap between the padding and the top of the model's head.

In FIG. 1, a perspective view of a male model, having a general reference numeral 10, is shown wearing a typical hard shell helmet 12. A top portion of the helmet 12 has been cutaway to illustrate foam padding 14 inside the helmet with a space 16 or gap between the padding 14 and a top of the model's head 18. Obviously, players of different ages, using hard shell helmets, have different sizes and shapes of heads. Therefore, the player's head may or may not be received in a snug and secure fit against the interior foam padding of the helmet and a space therebetween may exist. Thus, the player may use a loose fitting helmet.

Figure 1A:
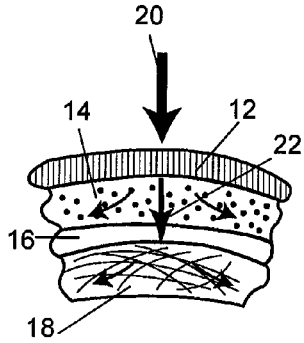
FIG. 1A is a sectional view taken along lines 1A-1A, shown in FIG. 1. In this drawing, a large arrow represents a shock load on the helmet. The shock load is transmitted into the foam padding and into the top of the model's head, as shown by a smaller arrow.

In FIG. 1A, a sectional view taken along lines 1A-1A, shown in FIG. 1, is illustrated. In this drawing, a large arrow 20 is shown representing a shock load on the helmet 12. The shock load 20 is transmitted into the foam padding 14 and into the top of the model's head 18, as shown by a smaller arrow 22 representing a dissipation of the shock load.

Figure 2:
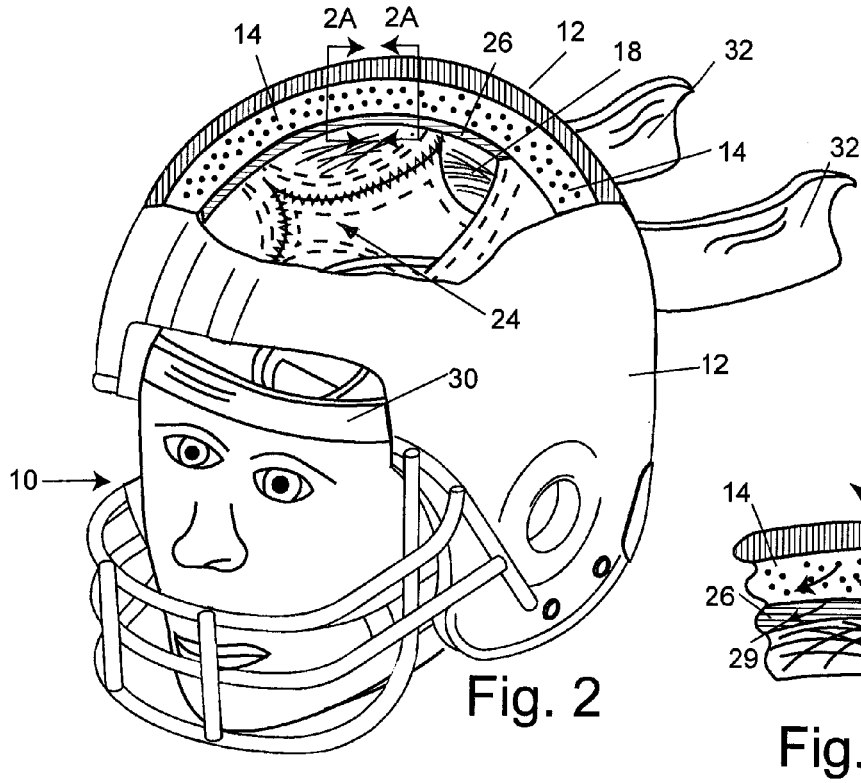
FIG. 2 is another perspective view, similar to FIG. 1, of the male model wearing the subject shock absorbing head cap under the hard shell helmet. A portion of the helmet has been cutaway to illustrate foam padding inside the helmet and the head cap on the model's head.

In FIG. 2, another perspective view, similar to FIG. 1, of the male model wearing the subject shock absorbing head cap, having a general reference numeral 24, is shown under the hard shell helmet 12. A portion of the helmet 12 has been cutaway to illustrate the foam padding 14 inside the helmet 12. Also, a portion of a light weight, shock absorbing, shock dissipating, head cap foam padding 26 is shown in cross section and compressed between the helmet's padding 14 and the model's head 18.

Figure 2A:
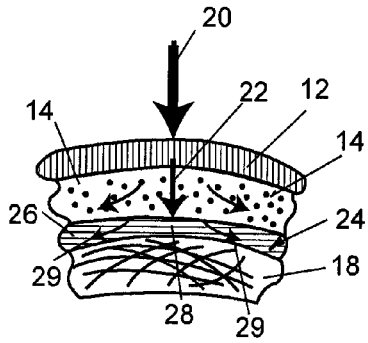
FIG. 2A is a sectional view taken along lines 2A-2A, shown in FIG. 2. In this drawing, a large arrow represents a shock load on the helmet. The shock load is transmitted into the foam padding and into the top of the head cap, as shown by a smaller arrow. The remaining shock load transmitted into the top of the player's head is shown as an even smaller arrow to indicated a reduction of the shock load to the head.

In FIG. 2A, a sectional view taken along lines 2A-2A, shown in FIG. 2, is illustrated. In this drawing, the large arrow 20 is shown again representing the shock load on the helmet 12. The shock load 20 is transmitted into the foam padding 14 and into the top of the head cap 20, as shown by a smaller arrow 22. The remaining shock load is transmitted through the head cap padding 26 into the top of the player's head. This feature is shown as an even smaller arrow 28 to indicated a reduction of the shock load to the head 18. While the player's head may or may not be received in a snug fit inside the helmet 12, the subject invention is designed to further dampen and dissipate the shock load placed thereon. In the drawing, the head cap 24 is shown with a stretchable, moisture absorbing head band 30 and a pair of spaced apart, head band ties 32 extending outwardly from the rear of the cap. The head band ties 32 are used to help tighten the head band 30 on the user's head. The head band ties 32 also provide added flair to the appearance of the head cap 24.

It should be noted that in the drawings, the head cap padding 26 can take on various geometric configurations disposed on the head cap 24 for quickly dissipating the shock load, as indicated by arrows 29, out the sides of the padding placed around the model's head 18.

Figure 3:
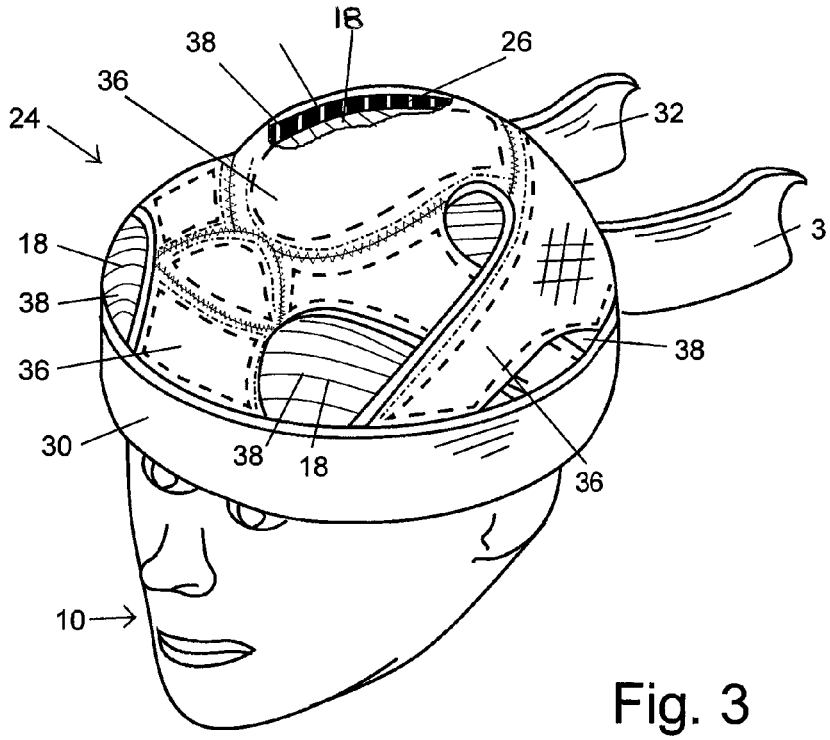
FIG. 3 is a front perspective view of one embodiment of the subject shock absorbing head cap on the male model. The head cap is shown with a head band, foam padding received inside moisture absorbing inner and outer fabric liners. This head cap includes open air spaces next to the foam padding for helping wick moisture away from the model's head.

In FIG. 3, a front perspective view of one embodiment of the subject shock absorbing head cap 24 is shown on the male model 10 and without the helmet 12. The head cap 24 is shown with the head band 30 and the head cap foam padding 26 received inside a moisture absorbing inner liner 34 and a moisture absorbing outer fabric liner 36. This embodiment of the head cap 24 includes open air spaces 38 next to the fabric covered, foam padding 26, shown in dashed lines, for helping wick moisture away from the model's head 18. In this drawing, a top portion of the head cap 24 has been cut away to illustrate the shock absorbing, shock dissipating head cap padding 26 in cross section.

Figure 4:
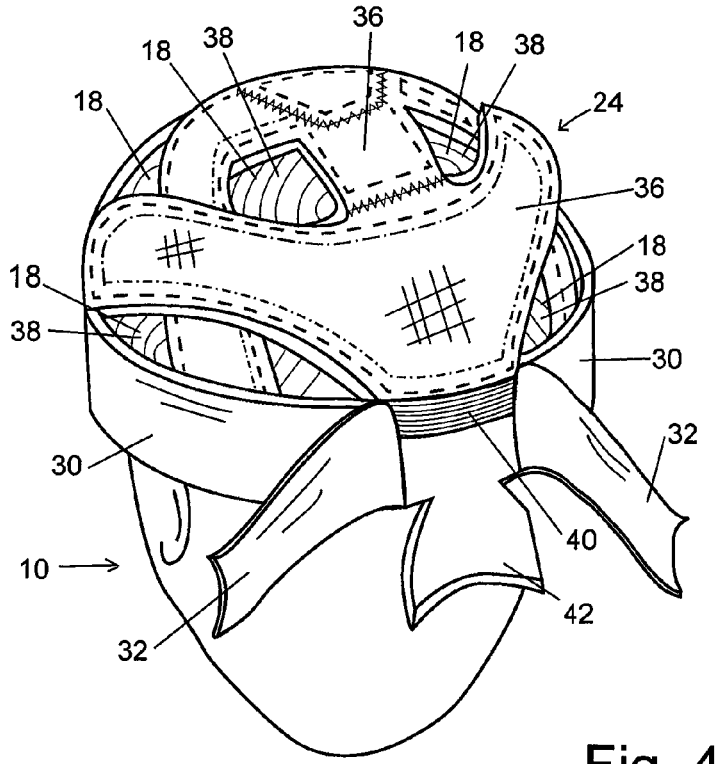
FIG. 4 is a rear perspective view of the head cap shown in FIG. 3 and with head band ties and an elastic strap attached to the back of the head band. The head cap also includes a beaver tail to prevent chaffing and rubbing by the helmet on the back of the player's neck.

In FIG. 4, a rear perspective view of the head cap 24, shown in FIG. 3, is illustrated with the head band ties 32 used of tightening the head band 30 on the head 18 of the model 10. Also, an elastic strap 40 is attached to the back of the head band 30 for holding the head cap 24 firmly on the model's head 18. The head cap 24 also includes a beaver tail 42 to help prevent chaffing and rubbing by the helmet 12 on the back of the player's neck.

Figure 5:
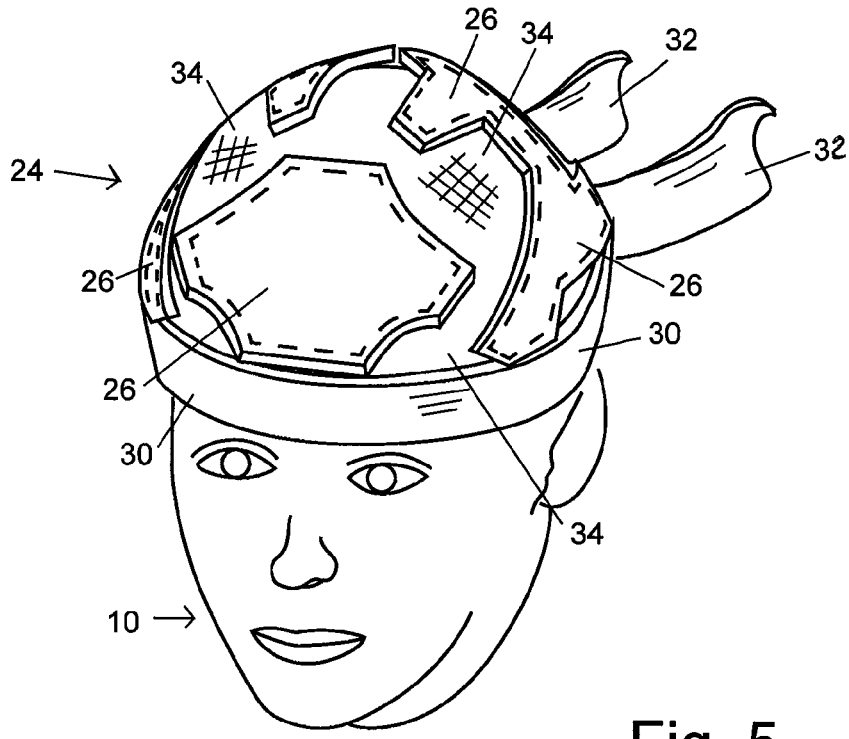
FIG. 5 is a front perspective view of another embodiment of the subject shock absorbing, fabric head cap and without open air spaces between the fabric covered foam padding.

In FIG. 5, a front perspective view of another embodiment of the subject shock absorbing, fabric head cap 24 is shown and without the open air spaces 18 between the fabric covered foam padding 26. In this drawing, the fabric outer liner 36 has been removed to illustrate the foam padding 26, stitched to the inner liner 34, strategically spaced next to the front of the head, the top of the head, the sides of the head and the back of the head, for increased protection against a potential head injury to key areas of the player's head.

Figure 6:
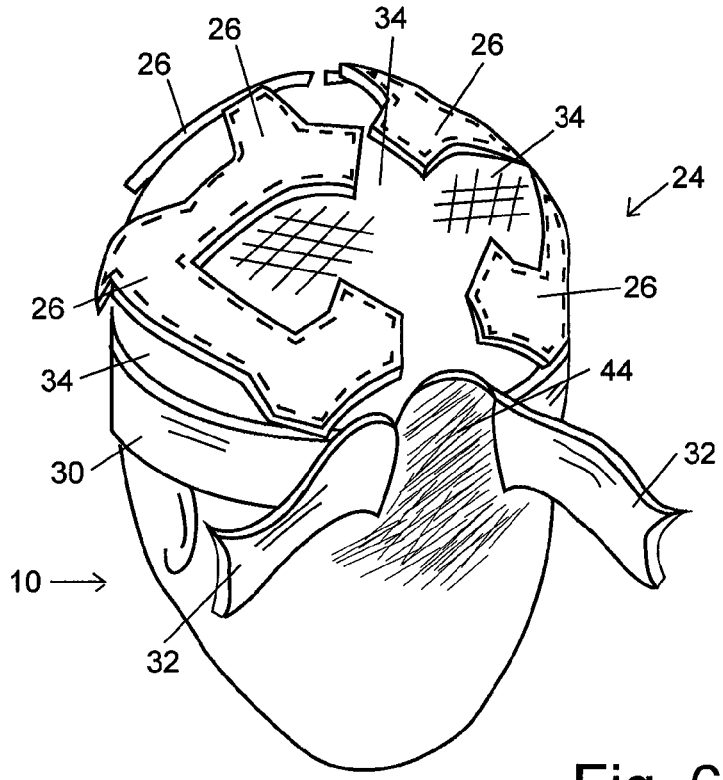
FIG. 6 is a rear perspective view of the head cap shown in FIG. 5 and with tie strings in the back of the head cap. The head cap also includes an opening between the tie strings for receiving the player's long hair therethrough.

In FIG. 6, a rear perspective view of the head cap 24, shown in FIG. 5, is illustrated and with the head band ties 32 extending outwardly from the back of the head cap. The head cap 24 also includes an opening 44, between the head band ties 32, for receiving the player's long hair therethrough.

Figure 7:
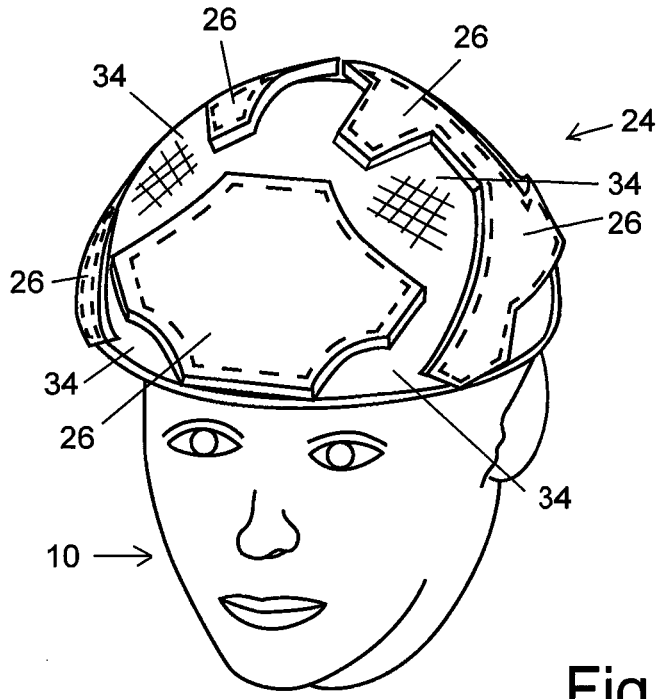
FIG. 7 is a front perspective view of still another embodiment of the shock absorbing, fabric head cap without a head band.

In FIG. 7, a front perspective view of still another embodiment of the shock absorbing, fabric head cap 24 is shown and without the head band 30. This illustration of the head cap 24 is also shown with the fabric outer liner 36 removed to illustrate the placement of the head cap foam padding 26 thereon.

Figure 8:
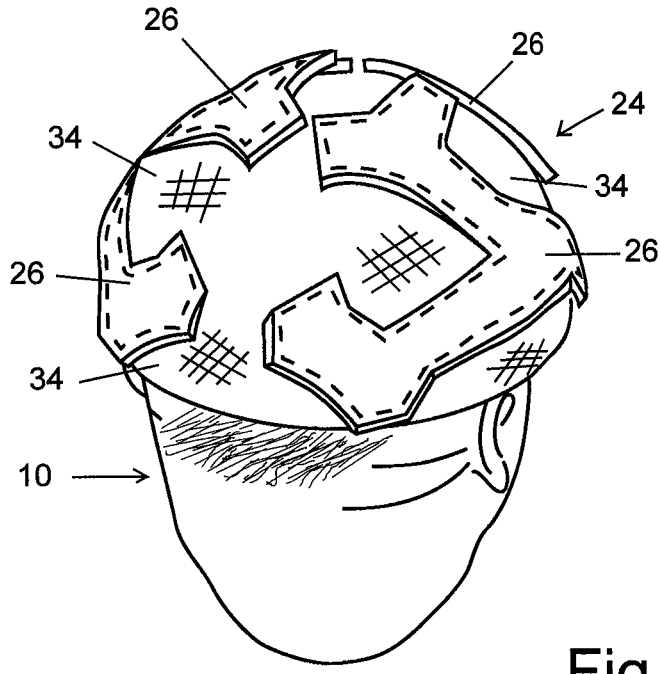
FIG. 8 is a rear perspective view of the head cap shown in FIG. 7 and without tie strings in the back of the cap.

In FIG. 8, a rear perspective view of the head cap 24, shown in FIG. 7, is illustrated. In this embodiment of the invention, the head cap is shown without head band ties 32 and the head band 30.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A stretchable fabric head cap adapted for receipt under a hard shell helmet and over a head of a helmet user, the head cap comprising:

a moisture absorbing fabric inner liner adapted for receipt over the head of the user;

a plurality of spaced apart, light weight, shock absorbing, shock dissipating head cap foam padding attached to a top of the inner liner, the head cap padding disposed in a front, on a top, on sides and in a back of the helmet user's head;

a moisture absorbing fabric outer liner received over the head cap padding and attached to the inner liner; and a moisture absorbing head band attached to a portion of the inner and outer liners, the head band adapted for receipt around the user's head.

2. The head cap as described in claim 1 further including air spaces between the head cap foam padding, the air spaces providing for enhanced wicking of moisture from the user's head during the wearing of the head cap.

3. The head cap as described in claim 1 further including an elastic strap attached to a rear portion of the head band, the elastic strap providing a tight fit of the head band on the user's head.

4. The head cap as described in claim 1 further including a pair of spaced apart, head band ties attached to a rear portion of the head band and extending outwardly therefrom, the head band ties used for tightening the head band on the head of the helmet user.

5. The head cap as described in claim 1 further including a beaver tail attached to a rear portion of the head band and extending downwardly therefrom, the beaver tail adapted for providing protection from rubbing and chaffing of a neck of the helmet user.

6. The head cap as described in claim 1 further including an opening in a rear portion of the head band, the opening adapted for providing receipt of long hair of the helmet user therethrough.

7. A stretchable fabric head cap adapted for receipt under a hard shell helmet and over a head of a helmet user, the head cap comprising:

a moisture absorbing fabric inner liner adapted for receipt over the head of the user;

a plurality of spaced apart, light weight, shock absorbing, shock dissipating head cap foam padding attached to a top of the inner liner, the head cap padding disposed in a front, on a top, on sides and in a back of the helmet user's head and providing shock protection from a shock load received on the helmet;

a moisture absorbing fabric outer liner received over the head cap padding and attached to the inner liner; and a moisture absorbing head band attached to a bottom portion of the inner and out liners, the head band adapted for receipt around the helmet users head.

8. The head cap as described in claim 7 further including air spaces between the head cap foam padding, the air spaces providing for enhanced wicking of moisture from the user's head during the wearing of the head cap.

9. The head cap as described in claim 7 further including an elastic strap attached to a rear portion of the head band, the elastic strap providing a tight fit of the head band on the helmet user's head.

10. The head cap as described in claim 7 further including a pair of spaced apart, head band ties attached to a rear portion of the head band and extending outwardly therefrom, the head band ties used for securing the head band on the head of the helmet user.

11. The head cap as described in claim 7 further including a beaver tail attached to a rear portion of the head band and extending downwardly therefrom, the beaver tail adapted for receipt next to a neck of the helmet user and providing protection from rubbing and chaffing of the neck.

12. The head cap as described in claim 7 further including an opening in a rear portion of the head band, the opening adapted for providing receipt of long hair of the helmet user therethrough.

13. A stretchable fabric head cap adapted for receipt under a hard shell helmet and over a head of a helmet user, the head cap comprising:

a moisture absorbing fabric inner liner adapted for receipt over the head of the user;

a plurality of spaced apart, light weight, shock absorbing, shock dissipating head cap foam padding attached to a top of the inner liner, the head cap padding disposed in a front, on a top, on sides and in a back of the helmet user's head and providing shock protection from a shock load received on the helmet;

a moisture absorbing fabric outer liner received over the head cap padding and attached to the inner liner;

a moisture absorbing head band attached to a bottom portion of the inner and out liners, the head band adapted for receipt around the helmet users head;

a pair of spaced apart, head band ties, the head band ties attached to a rear portion of the head band and extending outwardly therefrom, the head band ties adapted for tightening the head band on the head of the helmet user; and an opening in the rear portion of the head band and between the spaced apart, hear bands, the opening adapted for receiving the long hair of the helmet user therethrough.

14. The head cap as described in claim 13 further including air spaces between the head cap foam padding, the air spaces providing for enhanced wicking of moisture from the user's head during the wearing of the head cap.

* * * * *